United States Patent [19]

Müller

[11] 4,273,291

[45] Jun. 16, 1981

[54] FUEL INJECTOR FOR INTERNAL COMBUSTION ENGINES

[75] Inventor: Eckart Müller, Schwabach, Fed. Rep. of Germany

[73] Assignee: Maschinenfabrik Augsburg-Nürnberg Aktiengesellschaft, Nuremberg, Fed. Rep. of Germany

[21] Appl. No.: 960,832

[22] Filed: Nov. 15, 1978

[30] Foreign Application Priority Data

Nov. 15, 1977 [DE] Fed. Rep. of Germany ..... 2750928

[51] Int. Cl.[3] ..... B05B 1/30

[52] U.S. Cl. ..... 239/533.12

[58] Field of Search ..... 239/453, 533.3–533.12

[56] References Cited

U.S. PATENT DOCUMENTS

| | | | |
|---|---|---|---|
| 1,687,672 | 10/1928 | Lang | 239/453 |
| 2,186,216 | 1/1940 | Smith | 239/453 X |
| 2,512,557 | 6/1950 | Weldy | 239/453 |
| 3,035,780 | 5/1962 | Peras | 239/533.12 X |

FOREIGN PATENT DOCUMENTS

| | | | |
|---|---|---|---|
| 765971 | 6/1934 | France | 239/533.12 |
| 891037 | 3/1962 | United Kingdom | 239/533.4 |

*Primary Examiner*—Johnny D. Cherry

*Attorney, Agent, or Firm*—Becker & Becker, Inc.

[57] ABSTRACT

A fuel injector for internal combustion engines. The fuel injector is of the pin type and is provided with a nozzle needle which is axially displaceably mounted in a nozzle body and is adapted to be lifted off its valve seat in response to fuel pressure. A throttling pin of the nozzle needle extends below the valve seat into a nozzle bore which is arranged coaxial to the longitudinal axis of the injector. The nozzle bore is provided with a gap eccentrically arranged at one point or over part of the periphery of the nozzle bore.

8 Claims, 10 Drawing Figures

FUEL INJECTOR FOR INTERNAL COMBUSTION ENGINES

The present invention relates to a fuel injector for internal combustion engines. The fuel injector is of the pin type and is provided with a nozzle needle which is axially displaceably mounted in a nozzle body and is adapted to be lifted off its valve seat by the pressure of the fuel. A throttling pin of the nozzle needle extends below the valve seat into a nozzle bore which is arranged coaxial to the longitudinal axis of the injector.

With a heretofore known injector of this type, the pin is formed with a slightly reduced diameter at its free end to clear the nozzle bore to a greater or lesser degree depending on the existing fuel injection pressure. This configuration is intended to afford controlled pre-injection of the fuel in that the nozzle needle is held on its valve seat by means of two springs which have different characteristics and/or become operative at different times. The fuel spray orientation in all positions of the nozzle needle is always in the direction of the longitudinal axis of the nozzle needle; only the character of the fuel spray varies as the opening area increases.

It is well known that the quality of mixture formation in the combustion chamber of an internal combustion engine, apart from the spray characteristics, also depends significantly on the specific fuel spray orientation and/or direction. In this respect, it has long been considered to be advantageous for various methods of mixture formation to impart to the fuel spray, during starting and in the lower load and/or speed ranges of the engine, a direction by means of which a relatively high proportion of direct fuel-to-air mixing is produced, whereas in the upper load and/or speed ranges, a compact fuel spray is desirable in a direction toward the combustion chamber wall in order to avoid the well-known detrimental pressure peaks resulting from a too rapid combustion rate. This applies especially to internal combustion engines, which employ the process of wall deposition of the fuel, because in this method a large proportion of the fuel is intended to be applied filmwise onto the combustion chamber while the latter has a sufficiently high temperature.

With a view to satisfying these requirements, a number of proposals have been disclosed, all of which suffer from some drawback. For instance, one such proposal discloses an apparatus for deflecting the injection spray. According to this proposal, a temperature responsive adjustable deflector is provided in the region of the fuel spray. This deflector consists of a bimetallic of similar device and deflects the fuel toward the center of the combustion chamber when the latter is cold, whereas when the combustion chamber is hot, the fuel is directed toward the wall. This apparatus is based solely on temperature-responsive action, while spray characteristics and the injection pressure are not taken into consideration. Moreover, this apparatus is highly susceptible to problems.

There have been other proposals, providing for instance for the nozzle to be rotated during different load ranges of the engine, but, because of their complexity, they have not been widely accepted.

As mentioned above, the spray characteristics can be varied relatively easily by using a pin nozzle, which offers the additional advantage that the fuel pressure is available, substantially undiminished, at the nozzle bore throughout the entire injection phase.

It is therefore an object of the present invention to improve a fuel injector of the type described above, and having a pin nozzle, in a straightforward simple manner so that, by the respective positioning of the nozzle needle, the spray orientation and/or direction is automatically varied throughout the entire range of the operation or over part of this range of an engine in such a way as to always obtain a good mixture formation, and consequently, an efficient combustion. A secondary objective of the present invention consists in making it possible, in contrast to all prior art disclosures, for the fuel spray direction to be selectable in accordance with the physical conditions in such a way that it is oriented in the direction of the longitudinal axis of the injector either in the lower speed and/or load ranges or at full load.

These objects, and other objects and advantages of the present invention, will appear more clearly from the following specification in connection with the accompanying drawings, in which.

Figure 3:
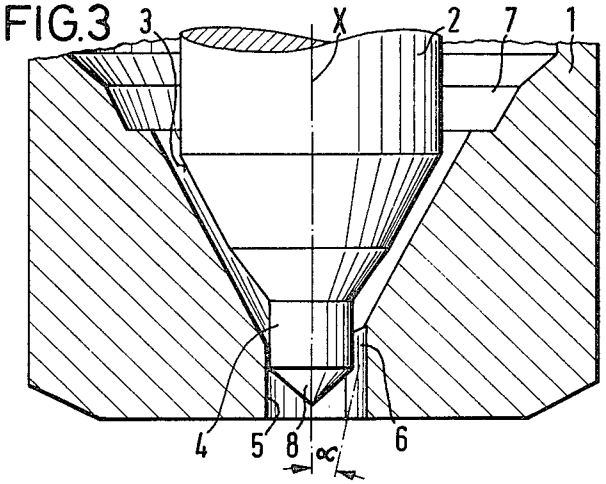
FIGS. 3 and 4 are variations of the injector of FIG. 1.

The fuel injector of the present invention is characterized primarily in that the nozzle bore is provided with an eccentrically arranged gap at one point or over part of its periphery. As a result of the easy-to-manufacture eccentric gap, it is possible to vary the spray direction in every instance. The timing and method of effecting this change as a function of the respective operating conditions of the engine are the subject of further features of the present invention.

Where the physical conditions permit the injector to be arranged so that at full load of the engine and/or in the upper speed range a compact fuel spray extends in a direction along the longitudinal axis of the injector, and so that in the lower speed and/or load ranges an atomizing spray extends at an angle relative to the longitudinal axis of the injector, then it is proposed that, by adjusting the needle lift, the length of the nozzle bore, and the shape of the throttling pin, the pin is situated completely or substantially completely outside the nozzle bore when the nozzle needle is fully open to uncover the complete spray area, whereas with the nozzle needle partially open, the pin extends into and forms a substantially tight fit with the nozzle bore. In other words, with full needle lift, the fuel spray is formed in the nozzle bore, whereas with the nozzle needle partially opened, the fuel spray is determined by the geometry of the gap, the nozzle bore, and the throttling pin.

If, and this should apply to the majority of cases, the compact fuel spray in the upper load range of the engine is intended to be at an angle relative to the longitudinal axis of the injector, and the atomizing spray in the lower load range is intended to be in the direction of the longitudinal axis, then it is proposed according to the present invention that the throttling pin should, while the nozzle needle is fully opened, extend slightly into the nozzle bore, and that the gap be formed in such a way that it will uncover the full spray area. In addition, even with the nozzle needle closed, a slight play should exist between the throttling pin and the nozzle bore. Inasmuch as the nozzle needle in its open position still extends into the nozzle bore, it prevents the formation of fuel spray in the direction of the longitudinal axis of the injector. Instead, the adequately large dimensioned gap imparts to the fuel spray a direction which is dictated by the geometry of the throttling pin, the gap, and the nozzle bore. At the start of the needle opening, the slight play referred to above produces an atomizing spray in the direction of the longitudinal axis. As the nozzle needle continues to open, this spray is gradually deflected into the desired direction as the gap slowly becomes effective. Consequently, this configuration permits the fuel spray direction to be varied as desired to meet any specific requirements.

The gap itself may be formed as a semi-circular, rectangular, or square recess, and may have a free cross-sectional area either of the same size over its full length or increasing in a direction toward the valve seat. The gap may also extend over the full length of the nozzle bore, or only over part of the length, depending on what type of fuel spray is to be produced. If the gap extends only over part of the length of the nozzle bore, the interface between the gap and the nozzle bore is expediently conical in shape or has a plane extending at an acute angle relative to the axis of the injector, as a result of which a more favorable spray deflection is obtained. The spray direction and, in particular, the spray characteristics, may of course also be variable by the shape of the end of the throttling pin.

Referring now to the drawings in detail, a nozzle needle 2 is axially displaceably mounted in the lower part 1 of the nozzle body. The nozzle needle 2 has a conical valve seat 3 and, at its lower end, a cylindrical throttling pin 4 which extends into a cylindrical nozzle bore 5 provided in the nozzle body 1. The nozzle bore 5 communicates at one point or over part of its periphery with a gap 6. Between the nozzle body 1 and the nozzle needle 2 there is provided a free space 7 for the supply of fuel.

Figure 1:
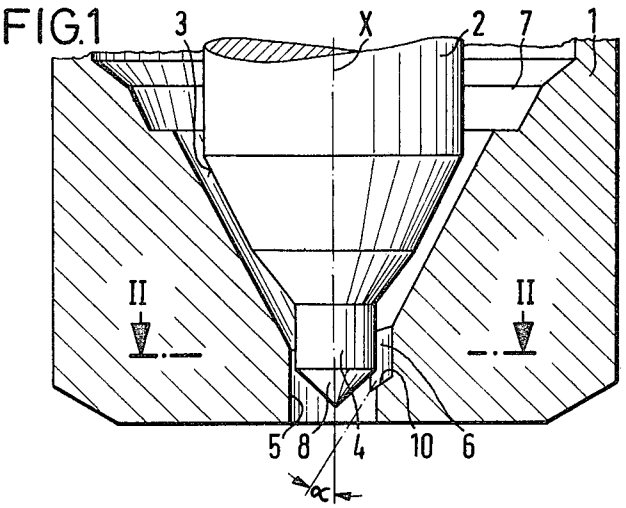
FIG. 1 is a longitudinal section through the lower part of an injector according to the present invention shown in a slightly open position, according to which the compact fuel spray which is obtained with full needle lift extends in the direction of the longitudinal axis of the injector.
Figure 2:
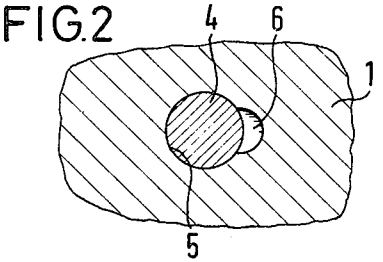
FIG. 2 is a section taken along the line II—II of the injector of FIG. 1.

In FIGS. 1 and 2, the gap 6 is a semicircular recess of constant free profile which, seen from the valve seat 3, extends parallel to the nozzle bore 5 only over part thereof and terminates in the nozzle bore 5 by means of the conical sealing surface 10. In the position of the nozzle needle 2 illustrated, the shape of the gap 6 already produces an atomizing spray at an angle defined, on the one hand, by the cone 8 provided on the pin 4 and, on the other hand, by the conical surface 10 of the gap 6 or the wall of the nozzle bore 5; the mean direction of the atomizing spray is invariably at an angle $\alpha$ to the longitudinal axis x of the injector. As the nozzle needle 2 continues to open, the injection angle and the spray angle decrease. When the nozzle needle 2 is finally in its open position, the pin 4 is completely or substantially completely outside the nozzle bore 5, and a compact fuel spray is produced which extends in the direction of the longitudinal axis x.

In FIG. 3, the gap 6 extends over the full length of the nozzle bore 5 and has a continuous uniform free cross section. The operation of this nozzle is the same as that shown in FIG. 1, except that the injection angle $\alpha$ is smaller in the initial throttling position.

Figure 4:
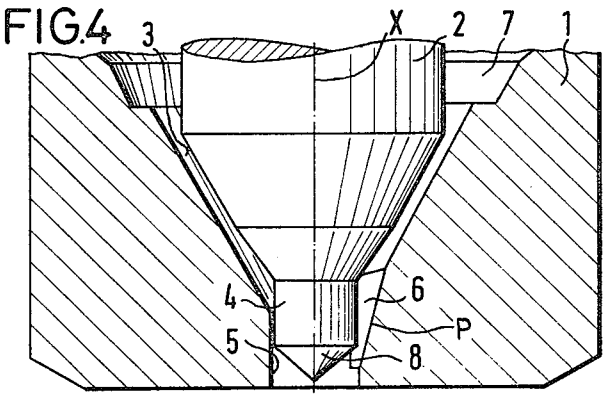

In FIG. 4, the free cross section of the gap 6 increases toward the valve seat 3, as a result of which the amount of fuel to be injected, the penetration force of the fuel spray, and the variation of direction can be better adapted to the specific conditions required. The interface between the gap and the nozzle bore includes a plane P extending at an acute angle to the longitudinal axis X of the nozzle body. Generally, its operation corresponds to that of the configuration of FIG. 1.

Figure 7:
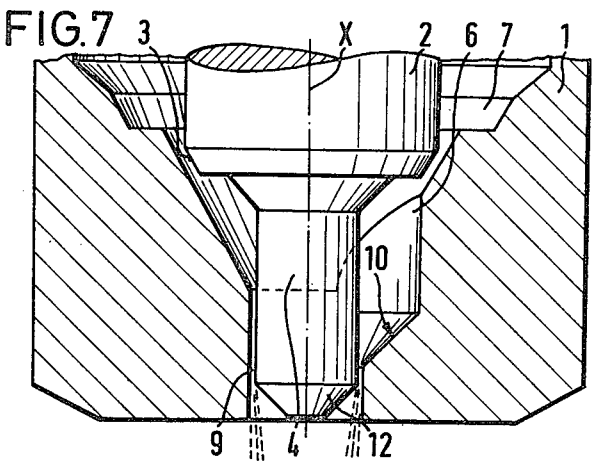
FIG. 7 shows the injector of FIG. 5 with the nozzle needle slightly lifted.
Figure 8:
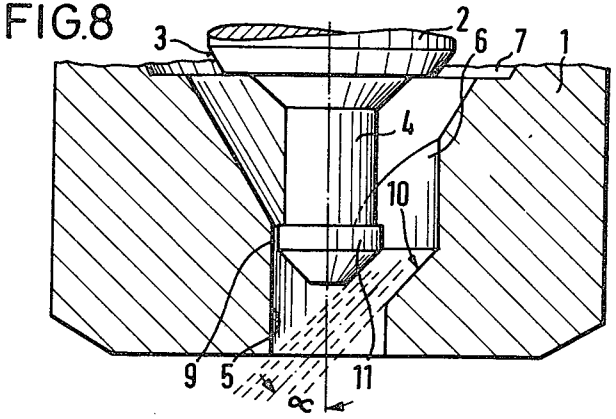
FIG. 8 shows the injector of FIG. 5 in the fully opened condition and with a slightly modified pin.
Figure 5:
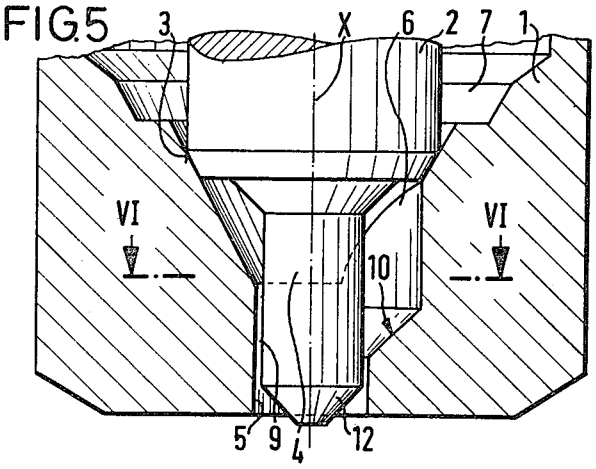
FIG. 5 is a longitudinal section through the lower part of an injector according to the present invention shown in a closed position, the compact fuel spray extending at an angle to the longitudinal axis of the injector.
Figure 6:
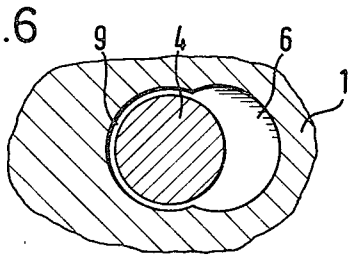
FIG. 6 is a section taken along the line VI—VI of the injector of FIG. 5.

FIGS. 5 and 8 respectively show the lower part of an injector which, while having substantially the same appearance as the injector of FIG. 1, works in a different manner. In this embodiment, a small play or clearance 9 is deliberately provided between the nozzle bore 5 and the throttling pin 4. The nozzle bore 5 and the pin 4 are somewhat longer, and the gap 6, as can be seen in particular from FIG. 6, has a considerably greater clear area. The free end of the pin 4 is a truncated cone 12. In its closed position, as shown in FIG. 5, the pin 4 is positioned with substantially its full length in the nozzle bore 5. If the nozzle needle 2 is slightly lifted from its valve seat 3, as shown in FIG. 7, fuel is already injected through the gap 6 and the clearance 9 as an atomizing spray into the cylinder and/or combustion chamber of the engine. This atomizing spray extends in the direction of the longitudinal axis x of the injector.

As the nozzle needle 2 is lifted further, the pin 4 gradually uncovers the gap 6. The fuel is now emitted mainly through this gap, as a result of which the spray changes its direction, so that the angle $\alpha$ becomes greater and, finally, as shown in FIG. 8 when the nozzle needle 2 is fully open, assumes that slant relative to the longitudinal axis x of the injector which is desired for full load.

In this open position, the pin 4 still extends slightly into the nozzle bore 5. This is necessary, on the one hand, to change the spray direction and, on the other hand, to provide the nozzle needle 2 and/or the pin 4 with guidance or support, since the fuel which is now being emitted only on one side can force the nozzle needle 2 against that side of the nozzle bore 5 which is opposite the gap 6. In order to minimize any frictional forces arising therefrom, since such friction could interfere with the proper sliding motion of the nozzle needle 2, it is expedient to reduce the diameter of the pin 4 and only its lower part serve as a modulating valve 11 with its maximum diameter (FIG. 8).

Figure 9:
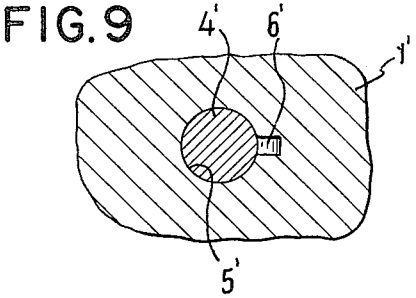
FIG. 9 shows a quadrangular recess gap in a section of the injector similar to that of FIG. 2.

FIG. 9 shows a quadrangular recess gap 6' in a section of the injector similar to that of FIG. 2.

Figure 10:
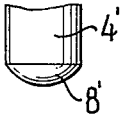
FIG. 10 shows a throttling pin having a free end of spherical section.

FIG. 10 shows a throttling pin 4' having a free end 8' of spherical section.

The present invention is, of course, in no way restricted to the disclosure of the drawings, but also encompasses any modifications within the scope of the appended claims.

What I claim is:

1. A fuel injector for internal combustion engines, which comprises in combination:

a nozzle body with a valve seat and having a wall including therewith a nozzle bore which is coaxial to the longitudinal axis of said nozzle body;

a nozzle needle which is axially displaceably arranged within said nozzle body and is provided with a valve seat, said valve seat of said nozzle needle being adapted to be lifted off said nozzle body in response to fuel pressure into an open position of said fuel injector, and being further adapted to have its valve seat rest against said nozzle body in a closed position of said fuel injector; and a throttling pin forming a part of said nozzle needle and extending into said nozzle bore at least during said closed position of said fuel injector, said nozzle bore being provided with an eccentrically arranged gap at at least one point of its periphery, said gap being located transverse to the wall of the nozzle bore and being so arranged that during slow lifting of said nozzle needle from the valve seat there results change of direction of discharging fuel stream with increasing stroke lifting thereof, said throttling pin extending into said nozzle bore at least during a portion of the lifting off of said valve seat of said nozzle needle from said nozzle body, said gap being a quadrangular recess.

2. A fuel injector for internal combustion engines, which comprises in combination:

a nozzle body with a valve seat and having a wall including therewith a nozzle bore which is coaxial to the longitudinal axis of said nozzle body;

a nozzle needle which is axially displaceably arranged within said nozzle body and is provided with a valve seat, said valve seat of said nozzle needle being adapted to be lifted off said nozzle body in response to fuel pressure into an open position of said fuel injector, and being further adapted to have its valve seat rest against said nozzle body in a closed position of said fuel injector; and a throttling pin forming a part of said nozzle needle and extending into said nozzle bore at least during said closed position of said fuel injector, said nozzle bore being provided with an eccentrically arranged gap at at least one point of its periphery, said gap being located transverse to the wall of the nozzle bore and being so arranged that during slow lifting of said nozzle needle from the valve seat there results change of direction of discharging fuel stream with increasing stroke lifting thereof, said throttling pin extending into said nozzle bore at least during a portion of the lifting off of said valve seat of said nozzle needle from said nozzle body, said gap having a constant free area over its entire length.

3. A fuel injector for internal combustion engines, which comprises in combination:

a nozzle body with a valve seat and having a wall including therewith a nozzle bore which is coaxial to the longitudinal axis of said nozzle body;

a nozzle needle which is axially displaceably arranged within said nozzle body and is provided with a valve seat, said valve seat of said nozzle needle being adapted to be lifted off said nozzle body in response to fuel pressure into an open position of said fuel injector, and being further adapted to have its valve seat rest against said nozzle body in a closed position of said fuel injector; and a throttling pin forming a part of said nozzle needle and extending into said nozzle bore at least during said closed position of said fuel injector, said nozzle bore being provided with an eccentrically arranged gap at at least one point of its periphery, said gap being located transverse to the wall of the nozzle bore and being so arranged that during slow lifting of said nozzle needle from the valve seat there results change of direction of discharging fuel stream with increasing stroke lifting thereof, said throttling pin extending into said nozzle bore at least during a portion of the lifting off of said valve seat of said nozzle needle from said nozzle body, said gap extending over the entire length of said nozzle bore.

4. A fuel injector for internal combustion engines, which comprises in combination:

a nozzle body with a valve seat and having a wall including therewith a nozzle bore which is coaxial to the longitudinal axis of said nozzle body;

a nozzle needle which is axially displaceably arranged within said nozzle body and is provided with a valve seat, said valve seat of said nozzle needle being adapted to be lifted off said nozzle body in response to fuel pressure into an open position of said fuel injector, and being further adapted to have its valve seat rest against said nozzle body in a closed position of said fuel injector; and a throttling pin forming a part of said nozzle needle and extending into said nozzle bore at least during said closed position of said fuel injector, said nozzle bore being provided with an eccentrically arranged gap at at least one point of its periphery, said gap being located transverse to the wall of the nozzle bore and being so arranged that during slow lifting of said nozzle needle from the valve seat there results change of direction of discharging fuel stream with increasing stroke lifting thereof, said throttling pin extending into said nozzle bore at least during a portion of the lifting off of said valve seat of said nozzle needle from said nozzle body, the interface between said gap and said nozzle bore being a plane extending at an acute angle to the longitudinal axis of said nozzle body.

5. A fuel injector for internal combustion engines, which comprises in combination:

a nozzle body with a valve seat and having a wall including therewith a nozzle bore which is coaxial to the longitudinal axis of said nozzle body;

a nozzle needle which is axially displaceably arranged within said nozzle body and is provided with a valve seat, said valve seat of said nozzle needle being adapted to be lifted off said nozzle body in response to fuel pressure into an open position of said fuel injector, and being further adapted to have its valve seat rest against said nozzle body in a closed position of said fuel injector; and a throttling pin forming a part of said nozzle needle and extending into said nozzle bore at least during said closed position of said fuel injector, said nozzle bore being provided with an eccentrically arranged gap at at least one point of its periphery, said gap being located transverse to the wall of the nozzle bore and being so arranged that during slow lifting of said nozzle needle from the valve seat there results change of direction of discharging fuel stream with increasing stroke lifting thereof, said throttling pin extending into said nozzle bore at least during a portion of the lifting off of said valve seat of said nozzle needle from said nozzle body, said throttling pin having a free end face which is a cone.

6. A fuel injector for internal combustion engines, which comprises in combination:

a nozzle body with a valve seat and having a wall including therewith a nozzle bore which is coaxial to the longitudinal axis of said nozzle body;

a nozzle needle which is axially displaceably arranged within said nozzle body and is provided with a valve seat, said valve seat of said nozzle needle being adapted to be lifted off said nozzle body in response to fuel pressure into an open position of said fuel injector, and being further adapted to have its valve seat rest against said nozzle body in a closed position of said fuel injector; and a throttling pin forming a part of said nozzle needle and extending into said nozzle bore at least during said closed position of said fuel injector, said nozzle bore being provided with an eccentrically arranged gap at at least one point of its periphery, said gap being located transverse to the wall of the nozzle bore and being so arranged that during slow lifting of said nozzle needle from the valve seat there results change of direction of discharging fuel stream with increasing stroke lifting thereof, said throttling pin extending into said nozzle bore at least during a portion of the lifting off of said valve seat of said nozzle needle from said nozzle body, said throttling pin having a free end which is a truncated cone.

7. A fuel injector for internal combustion engines, which comprises in combination:

a nozzle body with a valve seat and having a wall including therewith a nozzle bore which is coaxial to the longitudinal axis of said nozzle body;

a nozzle needle which is axially displaceably arranged within said nozzle body and is provided with a valve seat, said valve seat of said nozzle needle being adapted to be lifted off said nozzle body in response to fuel pressure into an open position of said fuel injector, and being further adapted to have its valve seat rest against said nozzle body in a closed position of said fuel injector; and a throttling pin forming a part of said nozzle needle and extending into said nozzle bore at least during said closed position of said fuel injector, said nozzle bore being provided with an eccentrically arranged gap at at least one point of its periphery, said gap being located transverse to the wall of the nozzle bore and being so arranged that during slow lifting of said nozzle needle from the valve seat there results change of direction of discharging fuel stream with increasing stroke lifting thereof, said throttling pin extending into said nozzle bore at least during a portion of the lifting off of said valve seat of said nozzle needle from said nozzle body, said throttling pin having a free end which is a section of a sphere.

8. A fuel injector for internal combustion engines, which comprises in combination:

a nozzle body with a valve seat and having a wall including therewith a nozzle bore which is coaxial to the longitudinal axis of said nozzle body;

a nozzle needle which is axially displaceably arranged within said nozzle body and is provided with a valve seat, said valve seat of said nozzle needle being adapted to be lifted off said nozzle body in response to fuel pressure into an open position of said fuel injector, and being further adapted to have its valve seat rest against said nozzle body in a closed position of said fuel injector; and a throttling pin forming a part of said nozzle needle and extending into said nozzle bore at least during said closed position of said fuel injector, said nozzle bore being provided with an eccentrically arranged gap at at least one point of its periphery, said gap being located transverse to the wall of the nozzle bore and being so arranged that during slow lifting of said nozzle needle from the valve seat there results change of direction of discharging fuel stream with increasing stroke lifting thereof, said throttling pin extending into said nozzle bore at least during a portion of the lifting off of said valve seat of said nozzle needle from said nozzle body, whereby in the open position, said throttling pin extends partially into said nozzle bore and said gap uncovers the spray area completely, and in which the closed position, a small clearance exists between said throttling pin and said nozzle bore, said clearance being adequate for injection of small quantities of fuel.

* * * * *